US006181279B1

(12) United States Patent
Van Hoozen

(10) Patent No.: US 6,181,279 B1
(45) Date of Patent: Jan. 30, 2001

(54) PATCH ANTENNA WITH AN ELECTRICALLY SMALL GROUND PLATE USING PERIPHERAL PARASITIC STUBS

(75) Inventor: Allen Lee Van Hoozen, Schaumburg, IL (US)

(73) Assignee: Northrop Grumman Corporation, Los Angeles, CA (US)

( * ) Notice: Under 35 U.S.C. 154(b), the term of this patent shall be extended for 0 days.

(21) Appl. No.: 09/075,091

(22) Filed: May 8, 1998

(51) Int. Cl.[7] ..... H01Q 1/24

(52) U.S. Cl. ..... 343/700 MS; 455/269; 455/767

(58) Field of Search ..... 343/700 MS, 767

(56) References Cited

U.S. PATENT DOCUMENTS

| | | | | |
|---|---|---|---|---|
| Re. 29,911 | | 2/1979 | Munson | 343/700 |
| 3,534,372 | | 10/1970 | Scheuerecker et al. | 343/742 |
| 3,683,390 | | 8/1972 | Cory et al. | 343/792.5 |
| 3,696,437 | | 10/1972 | Grant | 343/792.5 |
| 3,990,079 | | 11/1976 | Epis | 343/771 |
| 4,017,864 | * | 4/1977 | Proctor | 343/767 |
| 4,063,249 | | 12/1977 | Bergander et al. | 343/756 |
| 4,117,489 | | 9/1978 | Kaloi | 343/700 |
| 4,130,822 | * | 12/1978 | Conroy | 343/700 MS |
| 4,163,236 | | 7/1979 | Kaloi | 343/700 |
| 4,170,012 | | 10/1979 | Kaloi | 343/700 |
| 4,170,013 | * | 10/1979 | Black | 343/700 MS |
| 4,243,993 | | 1/1981 | Lamberty et al. | 343/895 |
| 4,326,203 | | 4/1982 | Kaloi | 343/700 |
| 4,364,050 | | 12/1982 | Lopez | 343/700 |
| 4,401,988 | | 8/1983 | Kaloi | 343/700 |
| 4,445,122 | | 4/1984 | Pues | 343/700 |
| 4,450,449 | | 5/1984 | Jewitt | 343/700 |
| 4,531,130 | * | 7/1985 | Powers et al. | 343/767 |
| 4,590,478 | * | 5/1986 | Powers et al. | 343/700 MS |
| 4,594,595 | | 6/1986 | Struckman | 343/770 |
| 4,608,572 | | 8/1986 | Blakney et al. | 343/792 |
| 4,761,654 | | 8/1988 | Zaghloul | 343/700 |
| 4,835,538 | | 5/1989 | McKenna et al. | 343/700 |
| 4,849,765 | | 7/1989 | Marko | 343/702 |
| 4,853,703 | * | 8/1989 | Murakami et al. | 343/700 MS |
| 4,864,314 | | 9/1989 | Bond | 343/700 |
| 4,907,011 | | 3/1990 | Kuo | 343/792.5 |
| 4,943,809 | | 7/1990 | Zaghloul | 343/700 |
| 5,005,019 | | 4/1991 | Zaghloul et al. | 343/700 |
| 5,008,681 | | 4/1991 | Cavallaro et al. | 343/700 |
| 5,021,796 | | 6/1991 | Corzine et al. | 343/712 |
| 5,111,211 | | 5/1992 | Dahlberg | 343/700 |
| 5,124,713 | | 6/1992 | Mayes et al. | 343/700 |
| 5,164,738 | | 11/1992 | Walter et al. | 343/789 |
| 5,187,490 | | 2/1993 | Ohta et al. | 343/700 |
| 5,191,351 | | 3/1993 | Hofer et al. | 343/895 |
| 5,210,541 | | 5/1993 | Hall et al. | 343/700 |
| 5,212,494 | | 5/1993 | Hofer et al. | 343/859 |
| 5,220,335 | | 6/1993 | Huang | 343/700 |
| 5,231,406 | | 7/1993 | Sreenivas | 343/700 |
| 5,309,163 | | 5/1994 | Ngan et al. | 343/700 |
| 5,313,216 | | 5/1994 | Wang et al. | 343/700 |
| 5,315,753 | | 5/1994 | Jensen et al. | 29/600 |
| 5,376,942 | | 12/1994 | Shiga | 343/700 |
| 5,382,959 | | 1/1995 | Pett et al. | 343/700 |

(List continued on next page.)

*Primary Examiner*—Don Wong
*Assistant Examiner*—James Clinger
(74) *Attorney, Agent, or Firm*—Terry J. Anderson; Karl J. Hoch, Jr.

(57) ABSTRACT

In accordance with the present invention, there is provided a patch antenna assembly having a generally planar patch antenna, defined by a first peripheral boundary, and a generally planar parasitic ground plate, disposed to spaced parallel relation to the patch antenna. The assembly further includes at least one conductive parasitic shielding element for segregating electromagnetic fields between the patch antenna and the ground plate. The shielding element is disposed in electrical communication with the ground plate and extends from the ground plate and substantially about the first peripheral boundary of the patch antenna.

80 Claims, 3 Drawing Sheets

U.S. PATENT DOCUMENTS

| | | | |
|---|---|---|---|
| 5,400,040 | 3/1995 | Lane et al. | 343/700 |
| 5,400,041 | 3/1995 | Strickland | 343/700 |
| 5,410,323 | 4/1995 | Kuroda | 343/700 |
| 5,448,250 | 9/1995 | Day | 343/700 |
| 5,448,252 | 9/1995 | Ali et al. | 343/700 |
| 5,453,751 | 9/1995 | Tsukamoto et al. | 343/700 |
| 5,471,220 | 11/1995 | Hammers et al. | 342/372 |
| 5,471,664 | 11/1995 | Kim | 455/323 |
| 5,477,231 | 12/1995 | Medard | 343/700 |
| 5,483,678 | 1/1996 | Abe | 455/80 |
| 5,497,164 | 3/1996 | Croq | 343/700 |
| 5,506,592 | 4/1996 | MacDonald et al. | 343/846 |
| 5,510,803 | 4/1996 | Ishizaka et al. | 343/700 |
| 5,565,875 | 10/1996 | Buralli et al. | 343/700 |
| 5,572,222 | 11/1996 | Mailant et al. | 343/700 |
| 5,576,718 | 11/1996 | Buralli et al. | 343/700 |
| 5,594,455 | 1/1997 | Hori et al. | 343/700 |
| 5,657,028 | 8/1997 | Sanad | 343/700 |
| 5,678,216 * | 10/1997 | Matai | 455/269 |
| 5,680,144 | 10/1997 | Sanad | 343/700 |
| 5,703,601 | 12/1997 | Nalbandian et al. | 343/700 |

* cited by examiner

PATCH ANTENNA WITH AN ELECTRICALLY SMALL GROUND PLATE USING PERIPHERAL PARASITIC STUBS

FIELD OF THE INVENTION

The present invention relates generally to patch antennas, and more particularly to a patch antenna having a relatively small ground plate using peripheral parasitic stubs.

BACKGROUND OF THE INVENTION

Patch antennas for transreceiving radio-frequency signals are well known. Such patch antennas generally comprise a patch antenna element which is suitable for receiving and/or transmitting at a desired frequency range or bandwidth. These patch antennas may be linearly or circularly polarized, for example.

A conventional patch antenna is provided with a ground plate or ground plane which is parallel to the antenna and spaced apart therefrom. Thus, the ground plate has a patch side and a non-patch side. Patch antennas such as these are characterized their bore sight directionality (perpendicular to the plane of the patch antenna and in a direction pointed away from the patch side of the ground plate). The ground plate tends to shield or mitigate external signals emanating from non-bore sight directions. Similarly, the ground plate acts to control the direction of outgoing signals when the antenna is used to transmit signals.

Besides defining the directionality of the antenna, the characteristics of the ground plate impacts the antenna performance. It is understood that such a transmitting/receiving patch antenna results in electromagnetic fields emanating between the patch antenna and the ground plate and that the patch antenna and its ground plate have an inductive relationship. The nature of these electromagnetic fields impacts the antenna performance. As such, changing the size of the ground plate affects the antenna gain and pattern or shape. To a certain extent, the larger the ground plate, the greater the antenna gain and the more defined the antenna pattern. In a conventional configuration, the ground plate is larger than the patch antenna. Take for example a patch antenna which is rectangular and defines a length and a width. Typically, the associated ground plate requires a length and a width of approximately three times or greater than that of the patch antenna for optimum or increased antenna performance in terms of gain and pattern shape. Thus, the ground plate would have a surface area of at least nine times greater than the patch antenna.

Based on the foregoing, it is clear that the sizing requirements of such a patch antenna/ground plate arrangement is dominated by the size of the ground plate. In addition, it is understood that the sizing requirements of an antenna assembly directly impacts the overall weight of the assembly. The size and weight of an antenna assembly may impact the range of application of the device. Thus, under certain circumstances it is highly desirable to reduce the size and weight of the antenna assembly without sacrificing antenna performance. It is therefore evident that there exists a need in the art for a patch antenna assembly having a patch antenna with a relatively small ground plate thereby reducing the overall size and weight of antenna assembly.

SUMMARY OF THE INVENTION

In accordance with the present invention, there is provided a patch antenna assembly having a generally planar patch antenna, defined by a first peripheral boundary, and a generally planar parasitic ground plate, disposed to spaced parallel relation to the patch antenna. The assembly further includes at least one conductive parasitic shielding element for segregating electromagnetic fields between the patch antenna and the ground plate. The shielding element is disposed in electrical communication with the ground plate and extends from the ground plate and substantially about the first peripheral boundary of the patch antenna. Preferably, the patch antenna and the ground plate are formed on a common dielectric substrate. The patch antenna, ground plate and shielding element are preferably formed of a similar metallic material.

In the preferred embodiment of the present invention, the antenna is sized and configured for a particular electromagnetic wavelength. The antenna and the ground plate are spaced approximately one twenty-fifth wavelength apart. Preferably, the dielectric material the antenna and the ground plate has a dielectric constant of four. In addition, the shielding element takes the form of a plurality of elongated cylindrical vias. Each of the vias extends from the ground plate towards the patch antenna and the vias collectively surround the patch antenna. The vias are spaced approximately one twenty-fifth of the predetermined wavelength apart or less. In such a configuration, it is preferable that the diameter of the vias are approximately one-two-hundredth of the predetermined wavelength.

The patch antenna may have a variety of polarizations and geometries. The antenna assembly may be further provided with other generally planar layers which may include circuity associated with generating and processing signal transmitted and received from the patch antenna. Thus, it is contemplated that the patch antenna and ground plate formed on the dielectric substrate may be combined with other substrate layers to conveniently form a board stack-up. In addition, the present invention further includes a patch antenna array which is provided with a plurality of patch antenna assemblies as described above.

In another embodiment of the present invention there is provided a method of making a patch antenna assembly. The method begins with the initial step of providing a generally planar dielectric substrate having first and second sides. A conductive material is affixed to the first and second sides of the dielectric substrate. Affixing the conductive material may be accomplished by using a metal plating process. A portion of the conductive material is removed from the first side to form a patch antenna from the remaining conductive material which. The patch antenna defines a first peripheral boundary. Additionally, a portion of the conductive material is removed from the first side of the dielectric substrate to form a plurality of discs having a first diameter from the remaining conductive material. The discs are formed about the first peripheral boundary of the patch antenna to collectively surround the antenna. The discs are formed to have a first diameter. The removal of the conductive material may be facilitated by an etching process. A plurality of holes are drilled through the center of the discs and through the underlying dielectric substrate. The holes are drilled to have a second diameter which is less than the first diameter of the discs. The holes are filled with a conductive material to electrically connect the discs to the conductive material on the second side of the dielectric substrate. A metal plating process may be used to fill the holes.

Based on the foregoing, the present invention mitigates the inefficiencies and limitations associated with prior art patch antenna assemblies. Advantageously, the present invention facilitates use of a reduced sized ground plate in comparison to a ground plate used in a conventional antenna arrangement for comparable antenna performance. Because the overall size of a patch antenna assembly is limited by the size of the associated ground plate, present invention facilitates an overall reduction in the size of the antenna assembly. Such reductions have a corresponding reduction in weight of the antenna assembly. It is contemplated that these reductions in size and weight of the antenna assembly facilitate expanded usage and range of application in circumstances where the size and/or weight constraints are important. In addition, the antenna assembly of the present invention may incorporate antennas having a variety of the polarizations (circular, linear, etc.). As such, the antenna assembly further facilitates a wide range of application.

With respect to ease of manufacture, the antenna assembly of the present invention does not require any special or extraordinary tooling requirements. Conventional methods of manufacture may be used, such as metal plating and drilling processes. In addition, in order to construct the antenna assembly of the present invention, no special or extraordinary materials are required. The dielectric substrate may take the form of an off-the-shelf printed wiring board and the patch antenna, ground plate and shielding member may be formed of a common metal plating. As such, it is contemplated that the antenna assembly of the present invention is contemplated to be relatively low in cost to fabricate.

Another significant advantage of the present invention is that the patch antenna assembly readily accommodates connection with other electronic components, such as signal generating and processing components. These components may be electrically connected to the patch antenna through the used of conductive vias which may pass through the plane of the ground plate. Such a design flexibility facilitates layered configuration to form an integrated electronic board stack-up.

Accordingly, the present invention represents a significant advance in the art.

BRIEF DESCRIPTION OF THE DRAWINGS

These, as well as other features of the present invention, will become more apparent upon reference to the drawings wherein:

FIG. 6 depicts a printed wiring board (pwb).

FIG. 7 depicts the pwb after being plated.

FIG. 8 depicts selective removal of portions of the plating.

FIG. 9 depicts the pwb after being drilled with holes.

FIG. 10 depicts the holes after being filled.

DETAILED DESCRIPTION OF THE PREFERRED EMBODIMENT

Figure 1:
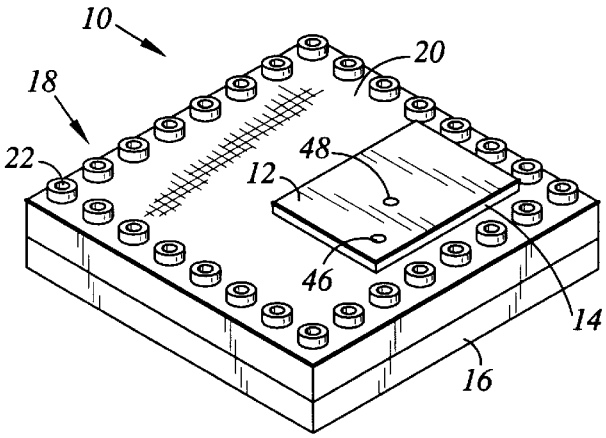
FIG. 1 is a perspective view of the patch antenna assembly of the present invention.
Figure 2:
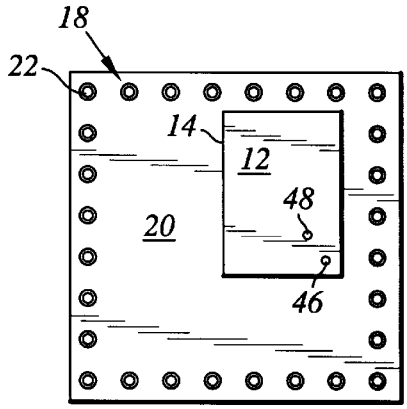
FIG. 2 is a top view of the patch antenna assembly depicted in FIG. 1.
Figure 3:
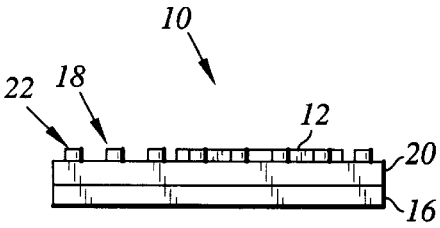
FIG. 3 is a side view of the patch antenna assembly as seen along axis 3—3 of FIG. 1.
Figure 4:
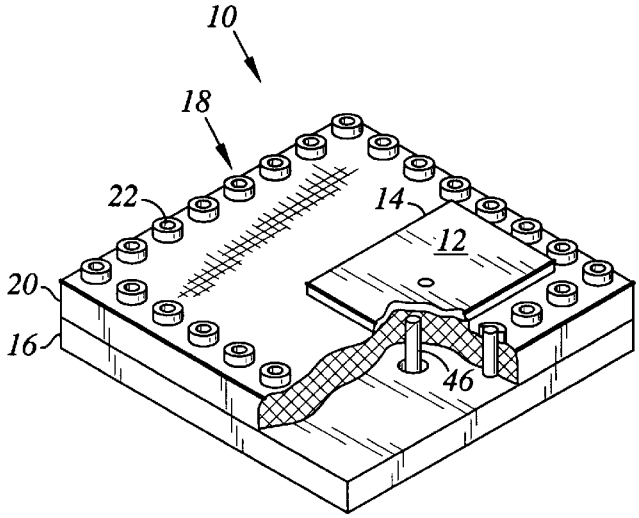
FIG. 4 is the patch antenna assembly as depicted in FIG. 1 illustrating a partial cross-sectional view.

Referring now to the drawings wherein the showings are for purposes of illustrating a preferred embodiment of the present invention only, and not for purposes of limiting the same, FIGS. 1–10 illustrate a patch antenna assembly which is constructed in accordance with the present invention. As will be described in more detail below, the patch antenna assembly is provided with a patch antenna having a relatively small ground plate.

Referring now to FIGS. 1–4, in accordance with the present invention, there is provided a patch antenna assembly 10 which is provided with a generally planar patch antenna 12 which defines a first peripheral boundary 14. The patch antenna assembly 10 is further provided with a generally planar parasitic ground plate 16 which is disposed parallel to the patch antenna 12 and in spaced relation thereto. The patch antenna assembly 10 is further provided with at least one conductive parasitic shielding element 18 for segregating electromagnetic fields between the patch antenna 12 and the ground plate 16. The shielding element 18 is disposed in electrical communication with the ground plate 16 and extends from the ground plate 16 and substantially about the first peripheral boundary 14 of the patch antenna 12.

Preferably, the patch antenna 12 and the ground plate 16 are formed on a common dielectric substrate 20 and the patch antenna 12, the ground plate 16 and the shielding element 18 are formed of a similar metallic material. For example, the dielectric substrate 20 may be formed of a printed wiring board (pwb). The material used to form the patch antenna 12, the ground plate 16 and the shielding element 18 may be copper, for example. Other suitable material selections are well known to those of ordinary skill in the art.

In the preferred embodiment of the present invention, the antenna 12 is sized and configured for a particular electromagnetic wavelength. The antenna 12 and the ground plate 16 are spaced approximately one twenty-fifth of such a wavelength apart. Preferably with such a spacing, the dielectric substrate material which is interposed between the antenna 12 and the ground plate 16 has a dielectric constant of four. It is contemplated that the antenna performance is impacted by the spacing with the ground plate 16 and the dielectric constant of the dielectric substrate 20.

In addition, the shielding element 18 takes the form of a plurality of elongated cylindrical vias 22. Each of the vias 22 extends from the ground plate 16 towards the patch antenna 12 and the vias 22 collectively surround the patch antenna 12. The stub shaped vias 22 are parasitic in nature, as these are not directly electrically connected to the patch antenna 12. It is understood that a parasitic element is one that is not coupled directly to the feed lines of an antenna and that materially affects the radiation pattern or impedance, or both, of an antenna. The vias 22 are spaced approximately one twenty-fifth of such a wavelength apart or less. In such a configuration, it is preferable that the diameter of the vias 22 are approximately one two-hundredth of the predetermined wavelength. The shielding element 18 has a height extending from the ground plate 16 of approximately equal or greater than that of the spacing between the patch antenna 12 and the ground plate 16.

The patch antenna 12 may have a variety of polarizations and they may be linearly or circularly polarized, for example. In addition, the geometry of the patch antenna 12 may take various forms including rectangular, circular and spiral, example. In the embodiment of the present invention where the patch antenna 12 is rectangular in shape, the antenna 12 defines a first length 24 and a first width 26. The associated ground plate 16 similarly defines a second length 28 and a second width 20. Preferably, the second length 28 is equal to or less than twice the first length 24 and the second width 30 is equal to or less than twice the first width 26. The patch antenna is provided with a first surface area and the ground plate 12 is provided with a second surface area. Preferably, the second surface area is equal to or less than four times the first surface area. It is contemplated, however, that the ground plate 16 defines a second peripheral boundary larger 32 than the first peripheral boundary 14 of the patch antenna 12. With respect to the ground plate 16, the patch antenna 12 may be aligned off-center or centered.

Figure 5:
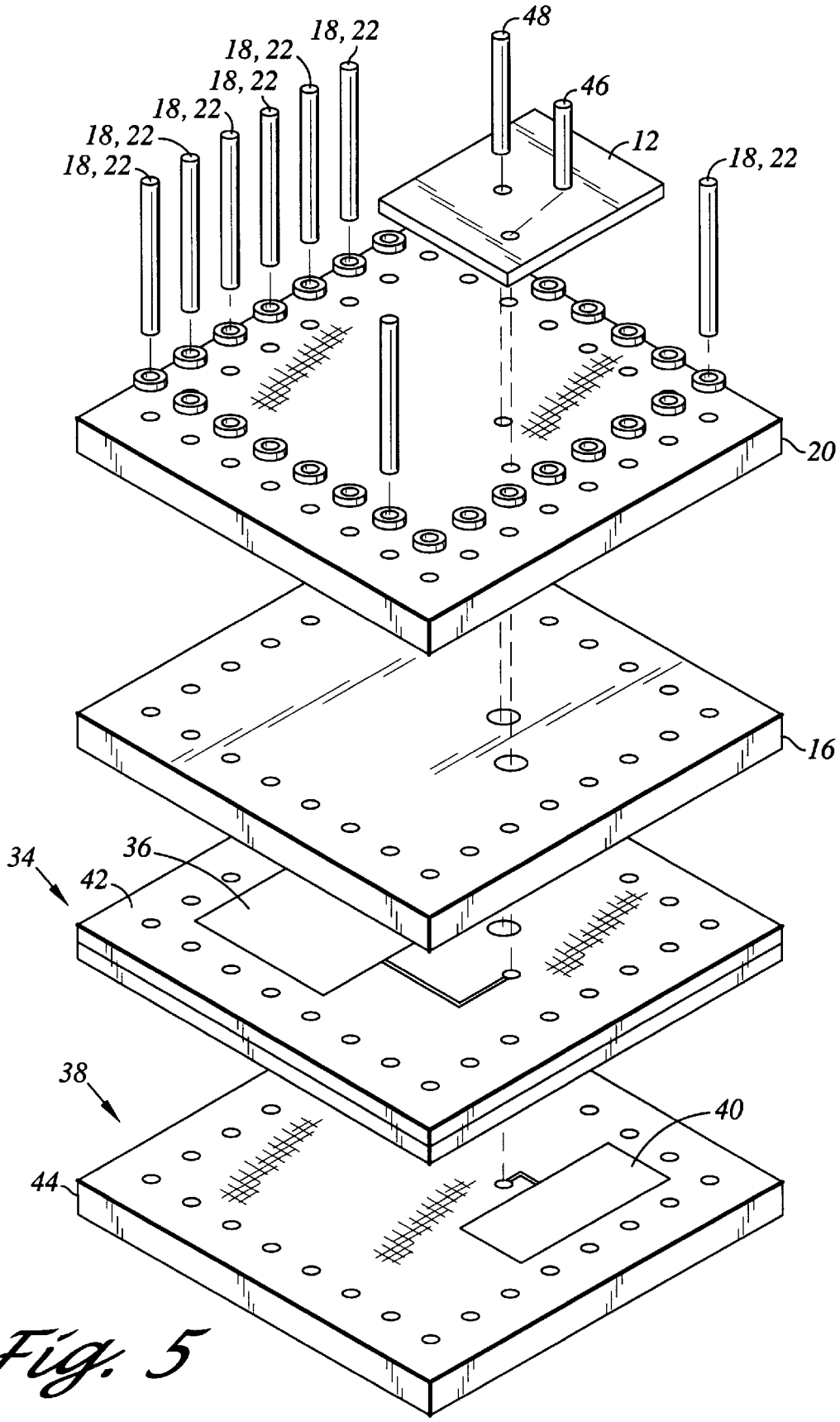
FIG. 5 is another embodiment of the present invention depicting an exploded perspective view.
Figure 6:
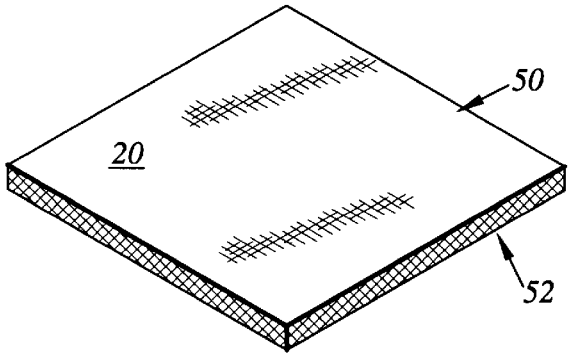
FIGS. 6–10 depict a method of constructing the patch antenna of the present invention.
Figure 7:
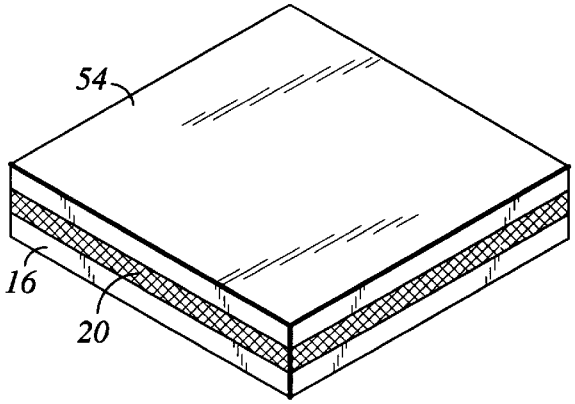
Figure 8:
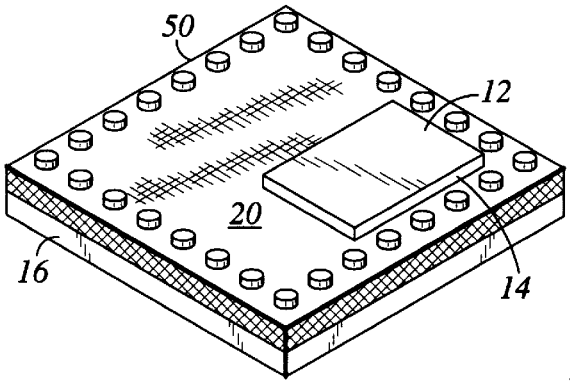
Figure 9:
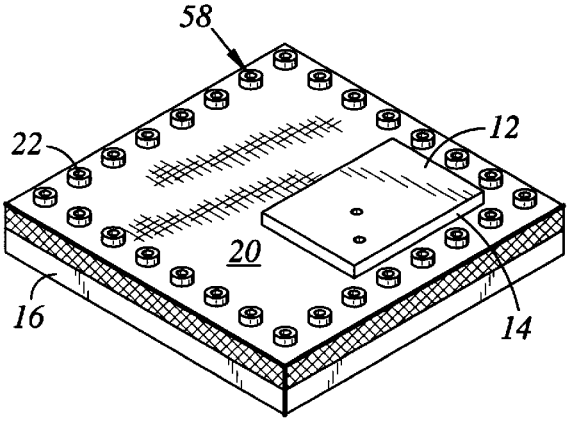
Figure 10:
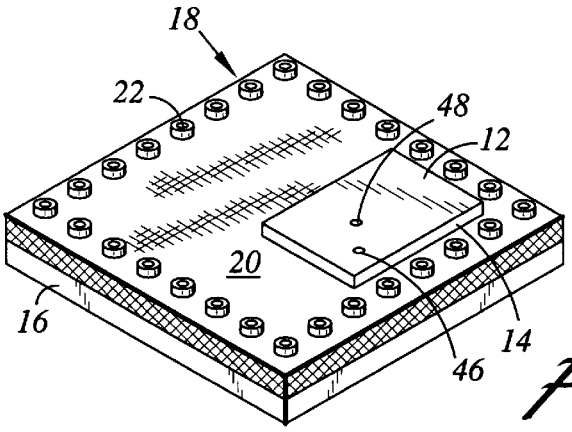

Referring now to FIG. 5, in another embodiment of the present invention, the antenna assembly 10 may be further provided with generally planar signal generating layer 34 for generating a transmission signal. The signal generating layer 34 includes signal generating circuitry 36 which is in electrical communication with the patch antenna 12 through a first feed via 46. The signal generating circuity 36 may include various components such as filters, mixers, oscillators amplifiers, etc. The antenna assembly 10 may be further provided with a generally planar signal processing layer 38 for processing a signal received with the patch antenna 12. The signal processing layer 38 includes signal processing circuitry 40, including signal processing chips for example. The signal processing circuitry 40 is in electrical communication with the patch antenna 12 through a second feed via 48. The signal generating and the signal processing layers 34, 38 may be formed on dielectric substrates 42, 44. Thus, it is contemplated that the patch antenna 12 and ground plate 16 formed on the dielectric substrate 20 may be combined with other substrates layers, such as substrates 42, 44, to conveniently form a board stack-up.

The shielding element 18, in the form of the vias 22, may extend from the ground plate 16 to the signal generating layer 34 and the signal processing layer 38 for shielding the signal generating and processing circuitry 36, 40 from external signals. The first and second feed vias 46, 48 may extend from the signal generating and processing circuitry 36, 40, through the ground plate 16 and terminate at the patch antenna 12 for facilitating electrical communication respectively between the signal generating circuitry 36 and the patch antenna 12, and the signal processing circuity 40 and the patch antenna 12. Advantageously, it is contemplated that the material forming the ground plate 16 may be selectively removed so as to permit the first and second feed vias 46, 48 to pass through ground plate 16 without being directly electrically connected to it.

In addition, although not shown, the present invention further includes a patch antenna array which is provided with a plurality of patch antenna assemblies 10 as described above.

In another embodiment of the present invention there is provided a method of making a patch antenna assembly 10 as described above. Referring now to FIGS. 6–10, the method begins with the initial step of providing a generally planar dielectric substrate 20 having first and second sides 50, 52. A conductive material 54 is affixed to the first and second sides 50, 52 of the dielectric substrate 20. Affixing the conductive material 54 may be accomplished by using a metal plating process. A portion of the conductive material 54 is removed from the first side so as to form a patch antenna 12 from the remaining conductive material 54. The patch antenna 12 defines a first peripheral boundary 14. Additionally, a portion of the conductive material 54 is removed from the first side 50 of the dielectric substrate 20 to form a plurality of discs 56 having a first diameter from the remaining conductive material. The discs 56 are formed about the first peripheral boundary 14 of the patch antenna 12 so as to collectively surround the antenna 12. The discs 56 are formed to have a first diameter. The removal of the conductive material 54 may be facilitated by an etching process. A plurality of holes 58 are drilled through the center of the discs 56 and through the underlying dielectric substrate 20. The holes 58 are drilled to have a second diameter which is less than the first diameter of the discs 56. The holes 58 are filled with a conductive material so as to electrically connect the discs 56 to the conductive material 54 on the second side 52 of the dielectric substrate 20 thereby forming shielding elements 18. A metal plating process may be used to fill the holes 58.

Additional modifications and improvements of the present invention may also be apparent to those of ordinary skill in the art. Thus, the particular combination of parts described and illustrated herein is intended to represent only one embodiment of the present invention, and is not intended to serve as limitations of alternative devices within the spirit and scope of the invention.

What is claimed is:

1. A patch antenna assembly comprising:

a generally planar patch antenna element defining a first peripheral boundary;

a generally planar ground plate disposed parallel to the patch element, the patch element aligned off-center from the ground plate; and a radiation and impedance pattern shaping shielding element connected to and extending from the ground plate and surrounding the patch element, while being electrically isolated from the patch element.

2. The antenna assembly of claim 1 wherein the shielding element comprises a plurality of vias for segregating electromagnetic fields between the patch antenna and the ground plate.

3. The antenna assembly of claim 2 wherein the vias being elongated and cylindrical in shape.

4. The antenna assembly of claim 2 wherein the antenna being sized and configured for a particular electro-magnetic wavelength and respective ones of the plurality vias being spaced approximately one twenty-fifth wavelength apart.

5. The antenna assembly of claim 1 wherein the antenna being sized and configured for a particular electro-magnetic wavelength and the antenna and the ground plate being spaced approximately one twenty-fifth wavelength apart.

6. The antenna assembly of claim 5 further comprising a dielectric material interposed between the antenna and the ground plate, the dielectric material having a dielectric constant of four.

7. The antenna assembly of claim 1 wherein the shielding element having a height extending from the ground plate approximately equal to the spacing between the patch antenna and the ground plate.

8. The patch antenna assembly of claim 1 wherein the patch antenna having a rectangular geometry.

9. The patch antenna assembly of claim 8 wherein the patch antenna having first length and a first width and the ground plate having a second length and a second width, the second length being approximately twice the first length and the second width being approximately twice the first width.

10. The patch antenna assembly of claim 8 wherein the patch antenna having first length and a first width and the ground plate having a second length and a second width, the second length being less than twice the first length and the second width being less than twice the first width.

11. The patch antenna assembly of claim 1 wherein the patch antenna having a first surface area and the ground plate having a second surface area, the second surface area being approximately four times the first surface area.

12. The patch antenna assembly of claim 1 wherein the ground plate defining a second peripheral boundary larger than the first peripheral boundary of the patch antenna.

13. The patch antenna assembly of claim 1 wherein the patch antenna being a linearly polarized antenna.

14. The patch antenna assembly of claim 1 wherein the patch antenna being a circularly polarized antenna.

15. The patch antenna assembly of claim 1 wherein the patch antenna having a circular geometry.

16. The antenna assembly of claim 1 wherein the patch antenna and the ground plate being formed on a dielectric substrate.

17. The antenna assembly of claim 1 wherein the patch antenna and the ground plate being formed of a metallic material.

18. The antenna assembly of claim 17 wherein the shielding element being formed of a metallic material.

19. The antenna assembly of claim 1 further comprising a generally planar signal generating layer for generating a transmission signal, the signal generating layer having signal generating circuitry in electrical communication with the patch antenna.

20. The antenna assembly of claim 19 wherein the shielding element extends from the ground plate to the signal generating layer for shielding the signal generating circuitry from external signals.

21. The antenna assembly of claim 19 further comprising a via extending from the signal generating circuitry and through the ground plate and terminating at the patch antenna for facilitating electrical communication between the signal generating circuitry and the patch antenna.

22. The antenna assembly of claim 1 further comprising a generally planar signal processing layer for processing a signal received with the patch antenna, the signal processing layer having signal processing circuitry in electrical communication with the patch antenna.

23. The antenna assembly of claim 22 wherein the shielding element extends from the ground plate to the signal processing layer for shielding the signal processing circuitry from external signals.

24. The antenna assembly of claim 22 further comprising a via extending from the signal processing circuitry and through the ground plate and terminating at the patch antenna for facilitating electrical communication between the signal processing circuitry and the patch antenna.

25. A patch antenna assembly comprising:

a generally planar patch antenna element defining a first peripheral boundary;

a generally planar ground plate disposed parallel to the patch element, the patch element being aligned off-center from the ground plate; and at least one radiation and impedance pattern shaping shielding element connected to and extending from the ground plate and surrounding the patch element, while being electrically isolated from the patch element.

26. A patch antenna array comprising a plurality of patch antenna assemblies, each of the patch antenna assemblies comprising:

a generally planar patch antenna element defining a first peripheral boundary;

a generally planar ground plate disposed parallel to the patch element, the patch element being aligned off-center from the ground plate; and at least one radiation and impedance pattern shaping shielding element connected to and extending from the ground plate and surrounding the patch element, while being electrically isolated from the patch element.

27. A method of making a patch antenna assembly comprising the steps of:

(a) providing a generally planar dielectric substrate having first and second sides;

(b) affixing a conductive material to the first and second sides of the dielectric substrate;

(c) removing a portion of the conductive material from the first side so as to form a patch antenna from the remaining conductive material which is defined by a first peripheral boundary;

(d) drilling a plurality of holes through the dielectric substrate about the first peripheral boundary of the patch antenna; and (e) forming an electrical connection with the conductive material of the second side but not the first side by filling the holes with a conductive material.

28. The method of claim 27 wherein step (b) comprises affixing the conductive material using a metal plating process.

29. The method of claim 27 wherein step (c) comprises removing a portion of the conductive material using an etching process.

30. The method of claim 27 wherein step (c) further comprises removing a portion of the conductive material from the first side of the dielectric substrate to form a plurality of discs having a first diameter from the remaining conductive material and step (d) further comprises drilling a plurality of holes through the discs and the dielectric substrate, the holes having a second diameter less than the first diameter of the discs.

31. The method of claim 30 wherein step (e) comprises filling the holes so as to electrically connect the discs to the conductive material on the second side of the dielectric substrate.

32. The method of claim 27 wherein step (e) comprises filling the holes using a metal plating process.

33. A patch antenna assembly comprising:

a generally planar patch antenna defining a first peripheral boundary;

a generally planar parasitic ground plate disposed parallel to the patch antenna and in spaced relation thereto;

a conductive parasitic shielding element for segregating electromagnetic fields between the patch antenna and the ground plate, the shielding element being in electrical communication with the ground plate, extending from the ground plate, and disposed substantially about the first peripheral boundary of the patch antenna;

a generally planar signal generating layer for generating a transmission signal, the signal generating layer having signal generating circuitry in electrical communication with the patch antenna in spaced relation to the first peripheral boundary and electrically isolated therefrom; and a via extending from the signal generating circuitry and through the ground plate and terminating at the patch antenna for facilitating electrical communication between the signal generating circuitry and the patch antenna.

34. The antenna assembly of claim 33 wherein the shielding element comprises a plurality of vias for segregating electro-magnetic fields between the patch antenna and the ground plate.

35. The antenna assembly of claim 34 wherein the vias being elongated and cylindrical in shape.

36. The antenna assembly of claim 34 wherein the antenna being sized and configured for a particular electromagnetic wavelength and respective ones of the plurality vias being spaced approximately one twenty-fifth wavelength apart.

37. The antenna assembly of claim 33 wherein the antenna being sized and configured for a particular electromagnetic wavelength and the antenna and the ground plate being spaced approximately one twenty-fifth wavelength apart.

38. The antenna assembly of claim 37 further comprising a dielectric material interposed between the antenna and the ground plate, the dielectric material having a dielectric constant of four.

39. The antenna assembly of claim 33 wherein the shielding element having a height extending from the ground plate approximately equal to the spacing between the patch antenna and the ground plate.

40. The antenna assembly of claim 33 wherein the patch antenna having a rectangular geometry.

41. The antenna assembly of claim 40 wherein the patch antenna having first length and a first width and the ground plate having a second length and a second width, the second length being approximately twice the first length and the second width being approximately twice the first width.

42. The antenna assembly of claim 40 wherein the patch antenna having first length and a first width and the ground plate having a second length and a second width, the second length being less than twice the first length and the second width being less than twice the first width.

43. The antenna assembly of claim 33 wherein the patch antenna having a first surface area and the ground plate having a second surface area, the second surface area being approximately four times the first surface area.

44. The antenna assembly of claim 33 wherein the ground plate defining a second peripheral boundary larger than the first peripheral boundary of the patch antenna.

45. The antenna assembly of claim 33 wherein the patch antenna being a linearly polarized antenna.

46. The antenna assembly of claim 33 wherein the patch antenna being a circularly polarized antenna.

47. The antenna assembly of claim 33 wherein the patch antenna having a circular geometry.

48. The antenna assembly of claim 33 wherein the patch antenna and the ground plate being formed on a dielectric substrate.

49. The antenna assembly of claim 33 wherein the patch antenna and the ground plate being formed of a metallic material.

50. The antenna assembly of claim 49 wherein the shielding element being formed of a metallic material.

51. The antenna assembly of claim 33 wherein the patch antenna being aligned off-center with respect to the ground plate.

52. The antenna assembly of claim 33 wherein the shielding element extends from the ground plate to the signal generating layer for shielding the signal generating circuitry from external signals.

53. The antenna assembly of claim 33 further comprising a generally planar signal processing layer for processing a signal received with the patch antenna, the signal processing layer having signal processing circuitry in electrical communication with the patch antenna.

54. The antenna assembly of claim 53 wherein the shielding element extends from the ground plate to the signal processing layer for shielding the signal processing circuitry from external signals.

55. The antenna assembly of claim 53 further comprising a via extending from the signal processing circuitry and through the ground plate and terminating at the patch antenna for facilitating electrical communication between the signal processing circuitry and the patch antenna.

56. A patch antenna assembly comprising:

a generally planar patch antenna defining a first peripheral boundary;

a generally planar parasitic ground plate disposed parallel to the patch antenna and in spaced relation thereto;

at least one conductive parasitic shielding element for segregating electro-magnetic fields between the patch antenna and the ground plate, the shielding element being in electrical communication with the ground plate, extending from the ground plate, and disposed exterior to the first peripheral boundary of the patch antenna in spaced relation to the first peripheral boundary and electrically isolated therefrom;

a generally planar signal generating layer for generating a transmission signal, the signal generating layer having signal generating circuitry in electrical communication with the patch antenna; and a via extending from the signal generating circuitry and through the ground plate and terminating at the patch antenna for facilitating electrical communication between the signal generating circuitry and the patch antenna.

57. A patch antenna array comprising a plurality of patch antenna assemblies, each of the patch antenna assemblies comprising:

a generally planar patch antenna defining a first peripheral boundary;

a generally planar parasitic ground plate disposed parallel to the patch antenna and in spaced relation thereto;

at least one conductive parasitic shielding element for segregating electro-magnetic fields between the patch antenna and the ground plate, the shielding element being in electrical communication with the ground plate, extending from the ground plate, and disposed exterior to the first peripheral boundary of the patch antenna in spaced relation to the first peripheral boundary and electrically isolated therefrom;

a generally planar signal generating layer for generating a transmission signal, the signal generating layer having signal generating circuitry in electrical communication with the patch antenna; and a via extending from the signal generating circuitry and through the ground plate and terminating at the patch antenna for facilitating electrical communication between the signal generating circuitry and the patch antenna.

58. A patch antenna assembly comprising:

a generally planar patch antenna element;

a generally planar ground plate disposed parallel to the patch element, the patch element being aligned off center from the ground plate;

a shielding element connected to and extending from the ground plate and surrounding the patch element, while being electrically isolated from the patch element;

a generally planar signal generating layer with circuitry connected to the patch element; and a via extending from the signal generating circuitry through the ground plate to the patch element.

59. The antenna assembly of claim 58 wherein the shielding element comprises a plurality of vias for segregating electro-magnetic fields between the patch element and the ground plate.

60. The antenna assembly of claim 59 wherein the vias being elongated and cylindrical in shape.

61. The antenna assembly of claim 59 wherein the patch element being sized and configured for a particular electromagnetic wavelength and respective ones of the plurality vias being spaced approximately one twenty-fifth wavelength apart.

62. The antenna assembly of claim 58 wherein the patch element being sized and configured for a particular electromagnetic wavelength and the patch element and the ground plate being spaced approximately one twenty-fifth wavelength apart.

63. The antenna assembly of claim 62 further comprising a dielectric material interposed between the patch element and the ground plate, the dielectric material having a dielectric constant of four.

64. The antenna assembly of claim 58 wherein the shielding element having a height extending from the ground plate approximately equal to the spacing between the patch element and the ground plate.

65. The antenna assembly of claim 58 wherein the patch element having a rectangular geometry.

66. The antenna assembly of claim 65 wherein the patch element having first length and a first width and the ground plate having a second length and a second width, the second length being approximately twice the first length and the second width being approximately twice the first width.

67. The antenna assembly of claim 65 wherein the patch element having first length and a first width and the ground plate having a second length and a second width, the second length being less than twice the first length and the second width being less than twice the first width.

68. The antenna assembly of claim 58 wherein the patch element having a first surface area and the ground plate having a second surface area, the second surface area being approximately four times the first surface area.

69. The antenna assembly of claim 58 wherein the ground plate defining a second peripheral boundary larger than the first peripheral boundary fo the patch element.

70. The antenna assembly of claim 58 wherein the patch element being a linearly polarized antenna.

71. The antenna assembly of claim 58 wherein the patch element having a circular geometry.

72. The antenna assembly of claim 58 wherein the patch element and the ground plate being formed ona dielectric substrate.

73. The antenna assembly of claim 58 wherein the patch element and the ground plate being formed of a metallic material.

74. The antenna assembly of claim 73 wherein the shielding element being formed of a metallic material.

75. The antenna assembly of claim 58 wherein the shielding element extends from the ground plate to the signal generating layer for shielding the signal generating circuitry from external signals.

76. The antenna assembly of claim 58 further comprising a generally planar signal processing layer for processing a signal received with the patch element, the signal processing layer having signal processing circuitry in electrical communication with the patch element.

77. The antenna assembly of claim 76 wherein the shielding element extends from the ground plate to the signal processing layer for shielding the signal processing circuitry from external signals.

78. The antenna assembly of claim 76 further comprising a via extending from the signal processing circuitry and through the ground plate and terminating at the patch element for facilitating electrical communication between the signal processing circuitry and the patch element.

79. A patch antenna assembly comprising:

a generally planar patch antenna element;

a generally planar ground plate disposed parallel to the patch element, the patch element being aligned off center from the ground plate;

at least one shielding element connected to and extending from the ground plate and surrounding the patch element, while being electrically isolated from the patch element;

a generally planar signal generating layer with circuitry connected to the patch element; and a via extending from the signal generating circuitry through the ground plate to the patch element.

80. A patch antenna array comprising a plurality of patch antenna assemblies, each of the patch antenna assemblies comprising:

a generally planar patch antenna element;

a generally planar ground plate disposed parallel to the patch element, the patch element being aligned off center from the ground plate;

a shielding element connected to and extending from the ground plate and surrounding the patch element, while being electrically isolated from the patch element;

at least one generally planar signal generating layer with circuitry connected to the patch element; and a via extending from the signal generating circuitry through the ground plate to the patch element.

* * * * *